United States Patent [19]

Slade

[11] 3,990,830

[45] Nov. 9, 1976

[54] MULTI-STAGE TROWEL FOR SMOOTHING PIPE LINING MATERIAL

[75] Inventor: Lester C. Slade, Santa Ana, Calif.

[73] Assignee: Ameron, Inc., Monterey Park, Calif.

[22] Filed: Apr. 7, 1975

[21] Appl. No.: 565,463

[52] U.S. Cl. ..... 425/460; 425/262

[51] Int. Cl.[2] ..... B28B 7/30

[58] Field of Search ..... 425/95, 110, 262, 457, 425/460, 469; 264/269–270; 118/105; 249/65

[56] References Cited

UNITED STATES PATENTS

| | | | |
|---|---|---|---|
| 2,261,928 | 11/1941 | Perkins et al. | 118/105 |
| 2,819,508 | 1/1958 | Martin | 425/262 |
| 3,257,698 | 6/1966 | Ruegsegger | 425/262 |
| 3,257,699 | 6/1966 | Ruegsegger | 425/262 |
| 3,334,389 | 8/1967 | Matheny | 425/262 |
| 3,384,940 | 5/1968 | Bartow | 425/460 |

FOREIGN PATENTS OR APPLICATIONS

| | | | |
|---|---|---|---|
| 1,455,675 | 10/1966 | France | 425/110 |
| 932,628 | 7/1963 | United Kingdom | 249/65 |

*Primary Examiner*—Francis S. Husar
*Assistant Examiner*—John McQuade
*Attorney, Agent, or Firm*—Christie, Parker & Hale

[57] ABSTRACT

A multi-stage frusto-conical trowel is towed by a machine which travels through a pipe and applies a layer of mortar to the inside surface of the pipe. The multi-stage trowel is carried on a rigid support member which is pivotally connected to the end of a towing rod extending to the rear of the mortar-dispensing machine. A first stage trowel with overlapping arcuate leaves is rigidly attached to the front of the support member and performs rough troweling of the mortar layer. A second stage trowel has overlapping arcuate leaves in which the leaf joints are offset circumferentially from the leaf joints of the first trowel. The second stage trowel is rigidly attached to the rear of the support member and performs finish smoothing of the mortar layer.

17 Claims, 4 Drawing Figures

MULTI-STAGE TROWEL FOR SMOOTHING PIPE LINING MATERIAL

BACKGROUND

This invention relates to a troweling apparatus for applying a protective coating of cement mortar or similar material to the inside surface of a pipe.

It is common for mortar or similar plastic material to be applied to the interior surfaces of pipelines already in place to recondition and protect the interior surfaces of such pipes.

A known type of coating applicator and troweling apparatus is disclosed in U.S. Pat. No. 3,384,940 to Barton. That patent discloses a mortar-dispensing machine which tows a multi-stage frusto-conical trowel. Each trowel in that patent includes a plurality of arcuate leaves which overlap circumferentially to form an expandable troweling edge at the larger and trailing end of the trowel. The first stage trowel is rigidly attached to a support rod extending to the rear of the mortar-dispensing machine. The second stage trowel is pivotally attached by a ball joint to the rear end of the support rod. The first stage trowel performs rough troweling of the mortar coating, and the pivotally-attached second stage performs finish smoothing.

In trowels having overlapping leaves, each overlap between adjacent leaves tends to form tracks or grooves in the coating material after the trowel passes. This is undesirable because the lining operation is intended to provide the smoothest possible surface for minimum friction losses when the lined pipe is placed in service. The purpose of a multi-stage trowel is to provide a second trowel for wiping out any tracks left by the first trowel to obtain the smoothest possible surface. However, the troweling machine in the Barton patent can have difficulty in smoothing tracks left by the first stage, because the pivotally-attached second trowel can rotate relative to the first trowel about an axis through the support rod and end up following the path left by the first trowel.

SUMMARY

This invention provides a multi-stage trowel which eliminates any tendency of the second trowel to follow the path of the first trowel. The invention provides a first stage trowel which performs the rough troweling, and a second stage trowel which wipes out any tracks left by the first stage to produce a smooth finish on the inside surface of the lined pipe.

Briefly, the invention includes a pair of longitudinally spaced apart frusto-conical trowels which are attached in tandem to a common rigid support member extending to the rear of a machine for applying a layer of coating material to the inside surface of a pipe. Each trowel comprises a plurality of circumferentially overlapping arcuate leaves. Each trowel is rigidly connected to the support member. The support member is adapted for pivotal connection to the machine for applying the coating material, and the support member is rigid continuously between the connection of the first trowel and the connection of the second trowel. The leaves of each trowel are urged outwardly with a substantially uniform force against the layer of coating material applied to the pipe.

In a preferred form of the invention, each of the leaf joints of the second trowel are offset circumferentially from the leaf joints of the first trowel. Since the two trowels are rigidly attached to the common rigid support member, the second trowel does not rotate relative to the first trowel. This prevents the leaf joints of the second trowel from tracking the path left by the leaf joints of the first trowel, and produces a smooth surface on the coating material.

Preferably, the leaves of the first trowel are urged outwardly against the coating material with a greater pressure than the leaves of the second trowel. In this way, the first stage is stiffer to effectively perform the rough troweling, and the second stage is more flexible to more effectively smooth out any imperfections left by the first stage.

Thus, the multi-stage trowel of this invention eliminates the tracks which tend to be formed by the leaf joints of prior art trowels, and thereby produces a smooth surface for minimum friction losses when the lined pipe is placed in service.

DRAWINGS

DESCRIPTION

Figure 1:
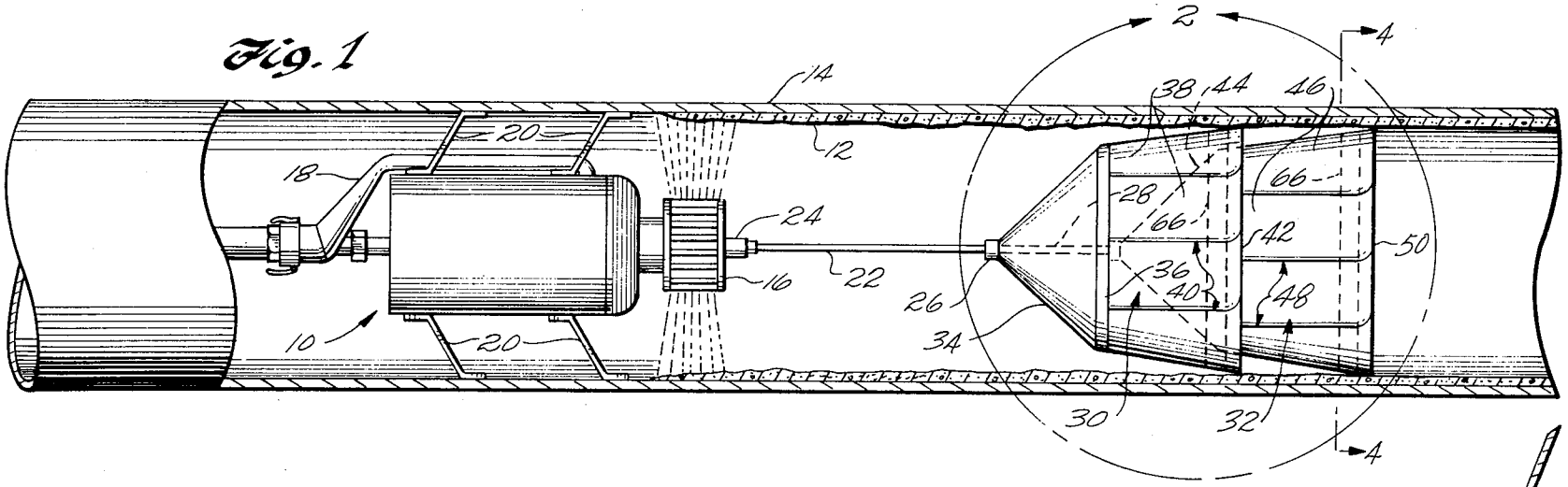
FIG. 1 is a fragmentary side elevation view, partly broken away, showing a pipe-lining machine using the improved multi-stage trowel of this invention.

Referring to FIG. 1, a pipe-lining machine 10 applies a layer 12 of plastic cement mortar to the inside surface of a pipe 14. A dispensing head 16 rotates about a horizontal axis to sling fresh mortar against the interior surface of the pipe. A hose 18 supplies mortar to the pipe-lining machine, and the machine is pulled from right to left (as viewed in FIG. 1) by any suitable traction means (not shown). Spider legs 20 are secured around the periphery of the pipe-lining machine and bear against the interior surface of the pipe to center the machine.

A longitudinally and horizontally extending flexible shaft 22 is secured at its forward end to the pipe-lining machine by a swivel joint 24 just aft of the dispensing head. Thus, the shaft 22 does not rotate with the dispensing head 16. The rear end of the shaft 22 includes a swivel joint 26 at the forward end of an elongated, rigid, tubular support member 28. A first stage frusto-conical trowel 30 is rigidly secured to the forward end of the rigid support member 28 immediately behind the swivel joint 26. A second stage frusto-conical trowel 32 is rigidly secured to the trailing end of the rigid support member 28.

Figure 2:
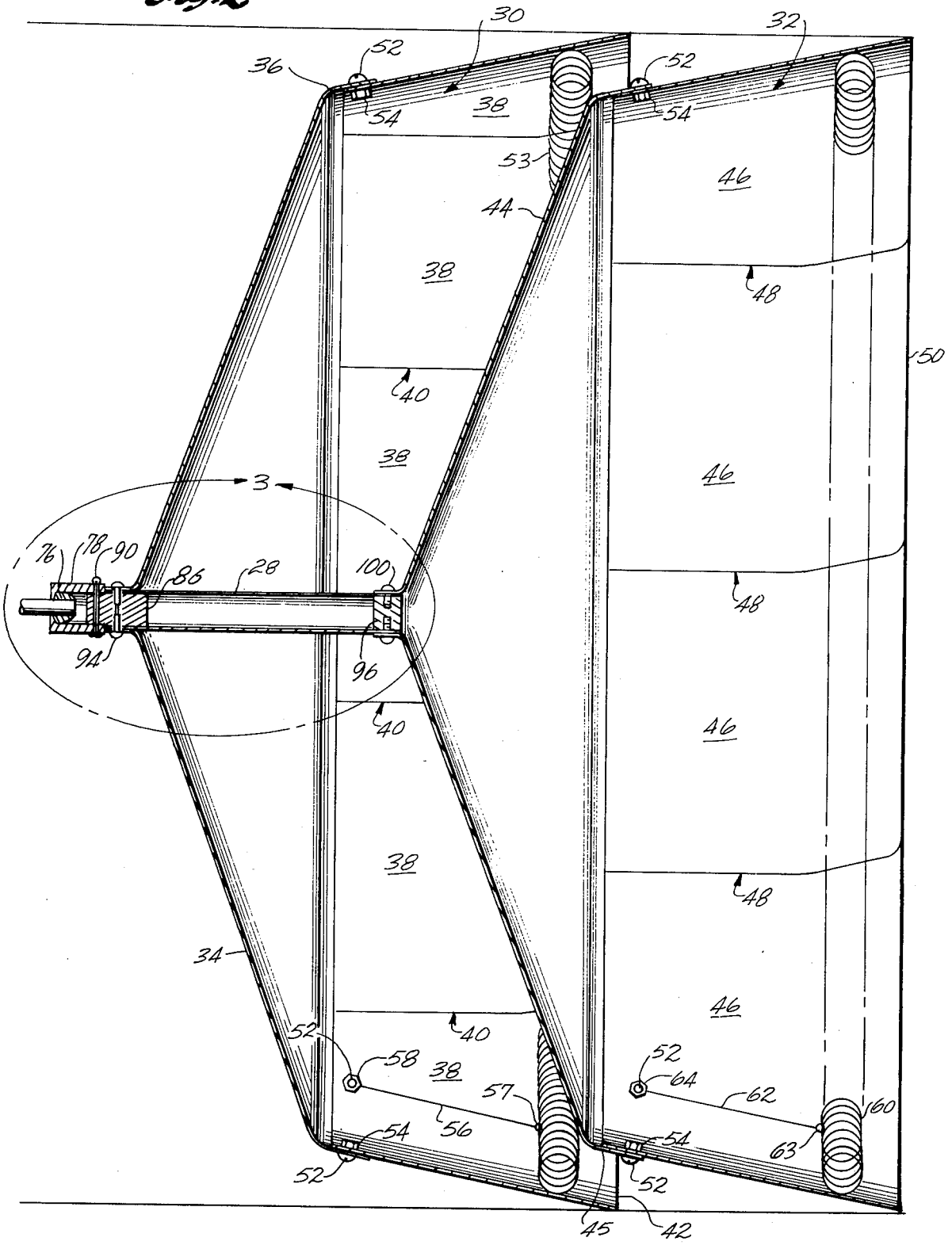
FIG. 2 is an enlarged fragmentary cross-sectional side elevation view showing the structure within the circle 2 of FIG. 1.

As shown in detail in FIG. 2, the first stage trowel 30 includes a frusto-conical nose section 34 which extends outwardly and rearwardly from the front portion of the support member 28. The rear end of the nose section 34 includes an annular skirt 36 tapered to extend rearwardly and outwardly at a smaller angle than the forward part of the nose section. A plurality of arcuate leaves 38 are disposed so that the longitudinally extending edges of adjacent leaves overlap to form joints 40 at equally spaced intervals around the circumference of the trowel. The trailing edges of the leaves 38 form a circular troweling edge 42.

The second stage trowel 32 is identical to the first stage and includes an outwardly and rearwardly extending frusto-conical nose section 44, an annular skirt 45 at the larger end of the nose section, a plurality of arcuate leaves 46 in which the longitudinal edges of adjacent leaves overlap to form joints 48 at equally spaced intervals around the circumference of the trowel, and a circular troweling edge 50 formed at the trailing edges of the leaves 46.

In each trowel, the forward end of each leaf is secured to its respective annular skirt by a separate respective screw 52 and nut 54 so that each leaf of each trowel is free to pivot slightly about the longitudinal axis of its respective screw. This allows the circumference of each circular troweling edge 42, 50, to be varied to accommodate pipes of various internal diameters.

As shown best in FIGS. 1 and 2, the joints 48 of the second stage trowel 32 are offset circumferentially from the joints 40 of the first stage trowel 30.

A circular compression spring 53 is disposed within the first stage trowel 30 adjacent to the troweling edge 42. The compression spring 53 is held in place by a plurality of longitudinally extending and circumferentially spaced apart rods 56, only one of which is shown for the purpose of simplicity. Separate loops 57 at the rear ends of the rods 56 fit around the spring 53 at equally spaced intervals. The forward end of each rod includes a respective nut 58 secured by a respective one of the screws 52 to the inside front end portion of a corresponding one of the leaves 38. The spring 53 supplies a spring biasing force against the inside surface of the leaves to urge the leaves outwardly with a substantially uniform force against the layer of mortar which is to be troweled as the troweling machine is pulled through the pipe.

The second stage trowel 32 includes a circular compression spring 60 identical in structure to spring 53. The compression spring 60 is held in place by a plurality of longitudinally extending and circumferentially spaced apart rods 62, only one of which is shown for simplicity. The rods 62 include separate loops 63 at their rear ends for fitting around the spring 60 at equidistantly spaced intervals. The forward end of each rod 62 includes a respective nut 64 for receiving a corresponding one of the screws 52 to attach the forward end of the rod 62 to the inside surface of a corresponding one of the leaves 46.

Figure 4:
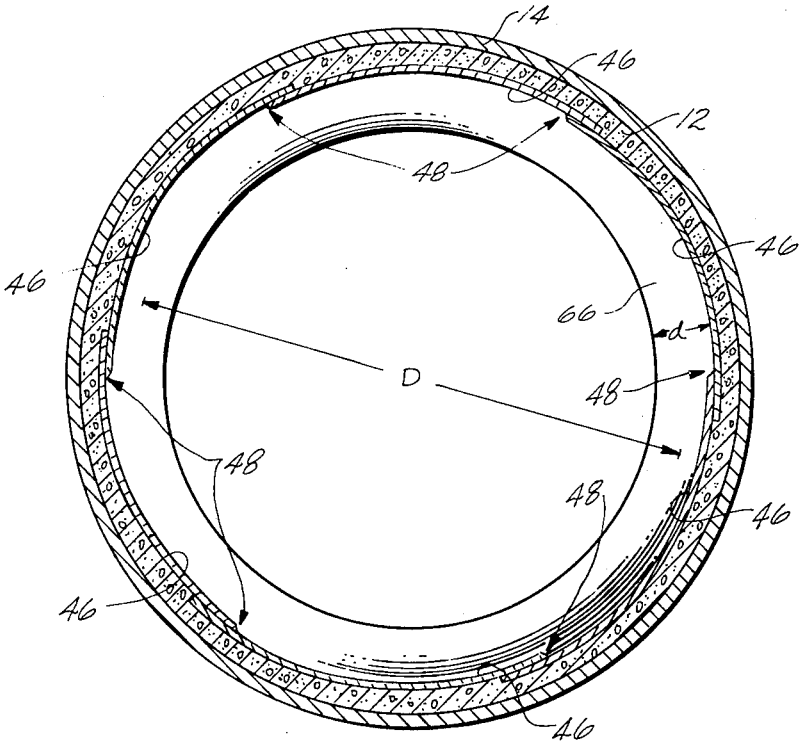
FIG. 4 is a cross-sectional elevation view, slightly enlarged, taken on the line 4—4 of FIG. 1, and showing an alternate form of the invention.

FIG. 4 shows an alternate form of the invention in which the compression springs 53 and 60 are replaced with an annular inflatable tube 66. The inflatable tube is used in applications involving pipes of large diameter, say, greater than 36 inches inside diameter, where the weight of a compression spring used instead of the inflatable tube would cause the spring to sag at the top and result in non-uniform troweling (essentially no troweling at the top of the trowel). The inflatable tube 66 is inflated by a conventional valve stem (not shown) to expand against the interior of the leaves 46 so they are urged outwardly with a uniform force against the layer of mortar to be troweled. The tube has a major diameter "D" which is substantially greater than the minor diameter *d* of the tube. The inflatable tube is held in place by a plurality of longitudinally extending rods (not shown) which are substantially identical to the rods 56 and 62, except that the rods preferably are spaced below the inside surfaces of the leaves by a distance about equal to the minor diameter *d*, and the rods have hooks (not shown) at their trailing edges which wrap around the inflatable tube.

Figure 3:
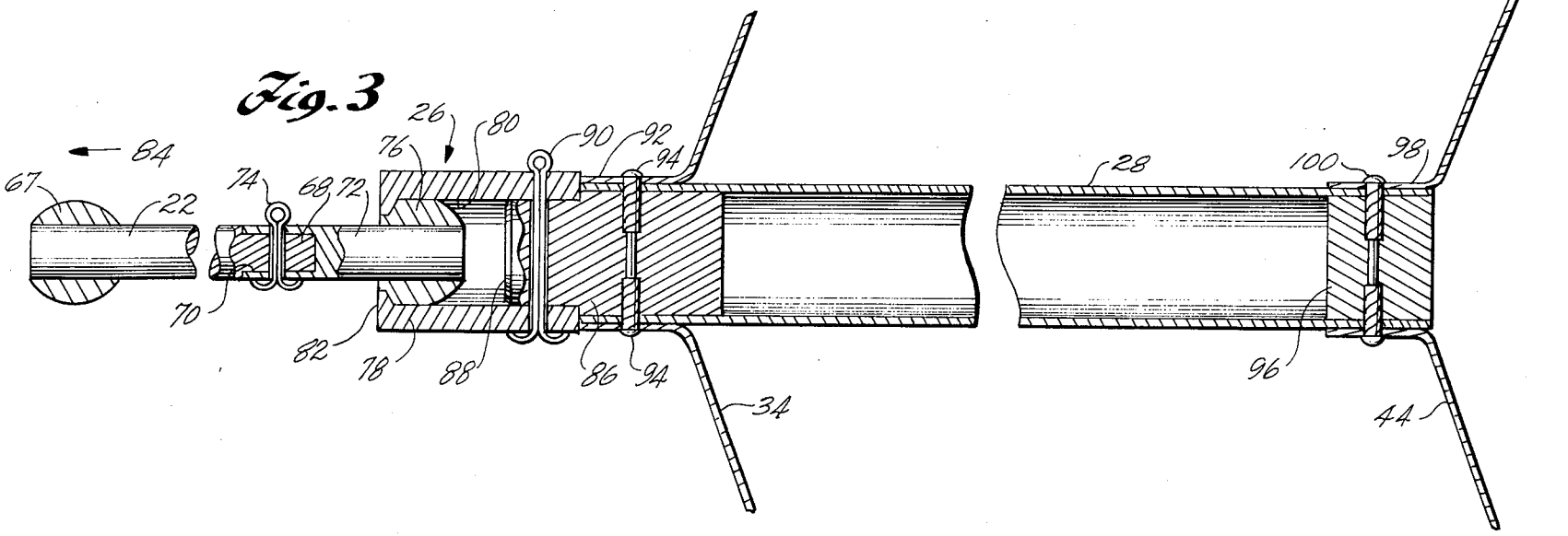
FIG. 3 is an enlarged fragmentary cross-sectional side elevation view, partly broken away, showing the structure within the circle 3 of FIG. 2.

The structures of the support member 28 and the means for mounting the two trowels on the support member 28 are shown best in FIG. 3. The front end of the tow rod 22 includes a ball bearing 67 for the swivel joint 24. The trailing end of the tow rod 22 includes a stepped-down stub shaft 68 which fits into a bore 70 in the front end of a bearing-holding rod 72. A cotter pin 74 attaches the bearing-holding rod 72 to the trailing end of the tow rod 22. The swivel joint 26 includes a ball bearing 76 secured to the trailing end of the bearing-holding rod 72. A sleeve 78 has a bore 80 for receiving the ball bearing 76. The front end section of the sleeve 78 includes a circular flange 82 which surrounds the bearing-holding rod 72 and provides a bearing surface for the ball bearing 76 when the tow rod 22 is pulled in the direction of the arrow 84 in FIG. 3. The trailing end of the sleeve 78 is rigidly attached to a bushing 86 mounted in the front end of the tubular support member 28. The bushing 86 has a stepped-down nose section 88 extending outwardly from the front end of the support rod 28. The nose section 88 matches the internal diameter of bore 80 in the sleeve 78 and fits into the rear portion of the bore 80. A cotter pin 90 extends through the sleeve 78 and the nose portion of the bearing 86 to rigidly attach the sleeve to the front end of the rigid support member 28. Thus, the front end of the support member 28 is pivotally attached by the swivel joint to the rear end of the two rod 22.

A longitudinally extending sleeve 92 extends in a forward direction away from the front of the nose section 34 of the first stage trowel. The sleeve 92 surrounds the front end portion of the support member 28. Screws 94 extend through the sleeve 92 to rigidly attach the front end section of the first stage trowel 30 to the front end portion of the support member 28.

A rear bushing 96 is mounted in the rear end of the tubular support member 28. A forwardly extending sleeve 98 at the front of the nose section 44 of the second stage trowel 32 surrounds the rear portion of the support member 28. Screws 100 extend through the sleeve 98 and into the bushing 96 to rigidly attach the front end portion of the second stage trowel to the rear end of the rigid support member 28.

In using the multi-stage trowel of this invention to line a pipe with cement mortar, the machine is operated in a conventional fashion to apply a layer of fresh mortar to the inside surface of the pipe. As the machine is pulled through the pipe, the troweling edge 42 of the first trowel 30 does the rough troweling, and the troweling edge 50 of the second trowel 32 produces a smooth finish to the mortar layer. Since the second stage trowel is supported with the first stage on a common support member which is rigid continuously from the point of attachment of the first trowel to the point of attachment of the second trowel, the second stage trowel is not able to rotate relative to the pipe about an axis through the support member. Therefore, the second trowel will not automatically follow the tracks of the first trowel, as it could if it were attached to the support member by a rotatable connection. Moreover, the leaf joints of the second trowel are offset circumferentially from those of the first trowel so that they will not track the path of the grooves left by the first stage trowel. Further, the spring tension of the first stage compression spring 53 is greater than the tension in the second stage compression spring 60. In this way, the leaves 38 of the first stage are urged outwardly against the mortar layer with a greater amount of pressure than the second stage leaves. This allows the first stage to do the rough troweling during its pass through the pipe. The second stage spring tension being lighter allows the leaves of the second stage to be more flexible so that the second stage only performs a smoothing function to smooth out any imperfections or tracks left by the first stage. The leaves 46 of the second stage trowel also may be made more flexible than the leaves of the first stage, say, by making the leaves 46 from a lighter, more resilient material. In the alternate embodiment using the inflatable tubes 66, the troweling pressure of the leaves in the first stage can be made greater than that of the second stage by inflating the first stage inflatable tube with a greater gas pressure than that of the second stage.

Thus, the multi-stage trowel of this invention provides a smooth surface of mortar on the inside of a pipe in a single pass of the troweling machine through the pipe, which substantially simplifies the troweling procedure and results in a minimum amount of friction losses when the lined pipe is placed in service.

I claim:

1. A multi-stage troweling device for being towed through a pipe behind a machine for applying a layer of protective coating material to the inside of the pipe comprising first and second frusto-conical trowels, each trowel having a plurality of circumferentially overlapping arcuate leaves forming a substantially circular troweling edge, an elongated rigid support member for being pivotally mounted behind the machine for applying the layer of coating material, means attaching the first and second trowels in tandem on the support member, and means urging the leaves of each trowel outwardly against the layer of coating material at longitudinally spaced apart locations so the troweling edge of the first trowel performs initial smoothing of the layer and the troweling edge of the second trowel performs finish smoothing of the layer when towed through the pipe, each trowel being rigidly attached to the support member, the support member being rigid continuously between the point of attachment of the first trowel and the point of attachment of the second trowel.

2. Apparatus according to claim 1 in which the overlapping portions of the leaves define circumferentially spaced apart leaf joints, and in which each of the leaf joints of the second trowel are offset circumferentially from the leaf joints in the first trowel.

3. Apparatus according to claim 1 including separate means on each trowel for applying pressure against the leaves of the trowel to urge the leaves outwardly with a substantially uniform force against the layer of coating material.

4. Apparatus according to claim 3 in which the pressure applying means comprises spring biasing means for applying pressure against the leaves of the trowel to urge the leaves outwardly with a substantially uniform force against the protective coating material, and in which the pressure applied by the spring biasing means is applied against the larger diameter end of the trowel.

5. Apparatus according to claim 3 in which the pressure applying means comprises an inflatable annular elastic tube disposed within the trowel adjacent its larger diameter, the annular tube having a major diameter substantially greater than its minor diameter.

6. Apparatus according to claim 1 including means urging the leaves of the first trowel outwardly to apply greater pressure against the layer of coating material than that applied by the leaves of the second trowel.

7. Apparatus according to claim 6 in which the overlapping portions of the leaves define circumferentially spaced apart leaf joints, and in which each of the leaf joints of the second trowel are offset circumferentially from the leaf joints of the first trowel.

8. Apparatus according to claim 1 in which the connection of the second trowel to the support member lies in a plane located forward of the plane in which the troweling edge of the first trowel is located.

9. Apparatus according to claim 6 in which the pressure applying means comprise separate spring biasing means for applying pressure against the leaves of each trowel at the larger diameter end of the trowel to urge the leaves outwardly with a substantially uniform force against the protective coating material, and in which the biasing force of the spring for the first trowel is greater than the biasing force of the spring for the second trowel.

10. Apparatus according to claim 6 in which the pressure applying means comprises a separate inflatable annular elastic tube disposed within each trowel adjacent its larger diameter, each annular tube having a major diameter substantially greater than its minor diameter, and means operatively connected to the annular tubes for inflating the annular tube of the first trowel to a greater pressure than that of the tube for the second trowel.

11. Apparatus according to claim 6 in which the leaves of the second trowel are made from a more resilient, lighter weight material than the leaves of the first trowel so that greater pressure is applied to the layer of coating material by the first trowel than the second trowel.

12. A multi-stage troweling device for being towed through a pipe behind a machine for applying a layer of protective coating material to the inside of the pipe comprising:

first and second frusto-conical trowels, each trowel having a plurality of circumferentially overlapping arcuate leaves, the overlapping portions of the leaves defining circumferentially spaced apart leaf joints in each trowel;

an elongated rigid support member for being pivotally mounted behind the machine for applying the layer of coating material;

means rigidly attaching the first and second trowels to longitudinally spaced apart locations on the support member so the trowels extend circumferentially away from the support member to contact the layer of coating material on the inside of the pipe, the support member being rigid continuously between the point of attachment of the first trowel and the point of attachment of the second trowel; and means urging the leaves of each trowel outwardly to apply pressure to the layer of coating material on the inside of the pipe, the leaves of the first trowel being urged outwardly to apply greater pressure against the layer of coating material than that applied by the leaves of the second trowel so the first trowel performs initial smoothing of the layer and the second trowel performs finish-smoothing of the layer when the trowels are towed through the pipe;

the leaf joints of the second trowel being offset circumferentially from the leaf joints of the first trowel to wipe out any tracks left by the first trowel.

13. Apparatus according to claim 12 including spring biasing means for applying pressure against the leaves of each trowel to urge the leaves outwardly with a substantially uniform force against the protective coating material, and in which the pressure applied by the spring biasing means is applied against the larger diameter end of each trowel, the spring tension in the spring biasing means of the first trowel being greater than that of the spring biasing means for the second trowel.

14. Apparatus according to claim 13 in which the larger end of each trowel provides a generally circular troweling edge, and in which the connection of the second trowel to the support member lies in a plane located forward of the plane in which the troweling edge of the first trowel is located.

15. Apparatus according to claim 12 including an inflatable annular elastic tube disposed within each trowel adjacent its larger diameter, the annular tube of each trowel having a major diameter substantially greater than its minor diameter, and means operatively connected to the annular tubes for inflating the tube of the first trowel to a greater pressure than that of the second trowel.

16. Apparatus according to claim 15 in which the larger end of each trowel provides a generally circular troweling edge, and in which the connection of the second trowel to the support member lies in a plane located forward of the plane in which the troweling edge of the first trowel is located.

17. Apparatus according to claim 12 in which the larger end of each trowel provides a generally circular troweling edge, and in which the connection of the second trowel to the support member lies in a plane located forward of the plane in which the troweling edge of the first trowel is located.

* * * * *